US005373681A

United States Patent [19]

Shigeta

[11] Patent Number: 5,373,681

[45] Date of Patent: Dec. 20, 1994

[54] LUG FOLDING APPARATUS FOR A PACKAGING DEVICE

[75] Inventor: Toshio Shigeta, Chiba, Japan

[73] Assignee: Tokyo Automatic Machinery Works, Ltd., Tokyo, Japan

[21] Appl. No.: 998,728

[22] Filed: Dec. 30, 1992

[30] Foreign Application Priority Data

Jan. 28, 1992 [JP] Japan ..... 4-013334

[51] Int. Cl.[5] ..... B65B 11/06; B65B 11/28

[52] U.S. Cl. ..... 53/225; 53/233; 53/234; 198/462; 198/475.1

[58] Field of Search ..... 53/224, 225, 233, 251, 53/234, 253, 372.5, 387.2; 198/462, 475.1

[56] References Cited

U.S. PATENT DOCUMENTS

| | | | |
|---|---|---|---|
| 3,439,473 | 4/1969 | Focke et al. | 53/234 |
| 3,789,576 | 2/1974 | Giles | 53/234 |
| 3,923,142 | 12/1975 | Rysti | 198/475.1 X |
| 3,992,855 | 11/1976 | Palmieri et al. | 53/234 X |
| 4,886,912 | 9/1989 | Deutsch . | |
| 4,999,970 | 3/1991 | Bamrungbhuet et al. . | |
| 5,046,258 | 9/1991 | Cahill et al. . | |

FOREIGN PATENT DOCUMENTS

| | | |
|---|---|---|
| 0295557 | 12/1988 | European Pat. Off. . |
| 61-39251 | 9/1986 | Japan . |
| 285109 | 3/1990 | Japan . |

OTHER PUBLICATIONS

Patent Abstracts of Japan No. 61-39251 (Laid-Open No. 57-131624), Sep. 1986.

English Language Abstract of European Patent 295,557; Dec. 1988.

*Primary Examiner*—Linda B. Johnson

*Attorney, Agent, or Firm*—Sandler, Greenblum & Bernstein

[57] ABSTRACT

A lug folding apparatus for a packaging machine in which box-like items, fed into pockets, are continuously circularly conveyed, during which a packaging sheet is wound or wrapped along the surface of each of the box-like items, the wound box-like items are transferred from the continuous circular conveyance to a linear conveyance, and the extended ends of the packaging sheet, protruding angularly from both sides of the box-like items, are folded along both sides thereof, the lug folding apparatus having a continuously rotating lug folding wheel provided with a plurality of pockets into which the wound box-like items are fed at equal intervals at the outer periphery thereof; a low speed conveyor which is partly in contact with a moving orbit of the pockets; a horizontal conveying path, opposite to the low speed conveyor, wherein the pockets are circularly moved while maintaining their horizontal state by rotation of the lug folding wheel, the pockets being provided with spaced portions to which projections of the low speed conveyor and the conveying path are accessible, and projections in contact with the box-like items within the pockets to press and feed them toward the openings of the pockets, the projections extending toward the conveying path.

8 Claims, 6 Drawing Sheets

LUG FOLDING APPARATUS FOR A PACKAGING DEVICE

BACKGROUND OF THE INVENTION

1. Field of the Invention

The present invention relates to a lug folding apparatus for a packaging machine in which a packaging sheet, such as cellophane, polypropylene, and so forth, is applied to a box-like item, for example, such as cigarettes packaged by a packaging film or paper. More specifically, the present invention relates to an apparatus in which box-like items, fed into pockets, are continuously conveyed in a circular fashion, during which continuously conveyed packaging sheets are applied along the surfaces of the box-like items. The continuous circular conveyance is changed to a linear conveyance of the box-like items, and extended ends of the packaging sheets, protruding angularly from both sides of the box-like items, are folded along both sides thereof.

2. Background and Material Information

Heretofore, the lug folding apparatus for a packaging machine of this kind is disclosed, for example, in Laid-Open Japanese Patent Publication No. Hei 2-85109. Between a continuously rotating winding wheel, having in the outer periphery thereof a plurality of pockets at equal intervals, and an intermittently rotating tray conveyor, having in the outer periphery thereof a plurality of pockets at equal intervals, an angularly extended chain conveyor is provided which has access to a predetermined section in the outer periphery of the winding wheel and a predetermined section in the outer periphery of the tray conveyor. The chain conveyor is curved in the form of a recess and a plurality of pockets are provided thereon having the same spacing as the spacing arrangement of the pockets of the winding wheel and the pockets of the tray conveyor. A linear conveyor is disposed downstream of the tray conveyor and box-like items, within the pockets, are circularly conveyed by the continuous rotation of the winding wheel. Packaging sheets are held so as to over the openings of the pockets during the circular conveyance. Thereafter, the pockets of the winding wheel are linearly opposed to the pockets of the continuously moving chain conveyor to deliver the box-like items from the pockets of the chain conveyor whereby the packaging sheets are wound in the shape of U along the surfaces of the box-like items and at the same time one narrow flap at the extended end is folded. Thereafter, both side ends of the packaging sheets, protruding from the pockets, are folded along the outer surfaces of the box-like items and heat-bonded. The other narrow flap, at the extended end, is folded when the box-like items are delivered from the pockets of the chain conveyor to the pockets of the tray conveyor. The box-like items are transferred from the pockets of the tray conveyor to the linear conveyor when the pockets stop, and both wide flaps are successively folded while the box-like items are being horizontally conveyed by the linear conveyor.

However, in this conventional lug folding apparatus for a packaging machine, as described above, the box-like items, continuously conveyed by the pockets of the winding wheel and the pockets of the chain conveyor, are transferred from the pockets of the intermittently rotating tray conveyor to the linear conveyor. This leads to the problem that the operating speed of the tray conveyor cannot be increased, and as a result, the winding wheel and the chain conveyor cannot be operated at high speeds. The processing speed is therefore thusly limited by permitting no increase in speed, thereby failing to provide a large quantity of packages in a short period of time.

Further, the narrow flap at the extended end is merely folded when the box-like item is forced into the pocket, and when the box-like item is extended from the pocket, the once folded flap sometimes returns to its original unfolded state. Particularly, in the case where the packaging sheets are films such as cellophane, polypropylene and so forth, the flap is liable to return to its unfolded state, and results in a defective folding. Thus, there occurs the problem that many defective products are generated.

In view of the above-described prior art shortcomings, it is an object of the present invention to transfer wrapped box-like items, from a continuous circular conveyance to a linear conveyance, without stopping the box-like items. A further object of the present invention is to re-fold a narrow flap after being extended from a pocket.

SUMMARY OF THE INVENTION

For resolving the aforementioned shortcomings, the technical means provided by the present invention utilizes a continuously rotating lug folding wheel, having in the outer periphery thereof a plurality of pockets, into which wrapped box-like items are fed, at equal intervals. A low speed horizontal conveyor moves at a speed lower than the horizontal moving speed of the pocket while partly coming into contact with the moving orbit of the pocket. A horizontal conveying path is provided opposite to the low speed conveyor, wherein the pocket is circularly moved while maintaining its horizontal state via rotation of the lug folding wheel. The pocket is provided with a spaced portion to which a projection of the low speed conveyor and the conveying path have access, and the low speed conveyor is provided with a projection which comes in contact with the box-like item within a pocket to press and feed it toward an opening of the pocket, said projection being projected toward the conveying path.

Preferably, a folding pawl, opposite to a narrow rear flap at an extended end of a preceding box-like item, is projected on the pocket of the lug folding wheel. On the left and right sides of the conveying path, a folding guide, opposite to a narrow front flap at the extended end, is fixedly arranged on the same plane as the left and right sides of the box-like item to be horizontally conveyed.

According to the aforementioned technical structure of the present invention, as the lug folding wheel continuously rotates, the pockets, into which the box-like items are fed, are circularly conveyed while maintaining their horizontal state, and the projections of the low speed conveyors are extended into the pockets to impinge on the box-like items. Thereby, the box-like items are relatively pressed and fed toward the opening form the pockets, due to the difference of the horizontal moving speed between the pockets and the low speed conveyor, and transferred to a horizontal conveying path.

Thereafter, the box-like items, transferred to the conveying path, are horizontally conveyed by the projections of the low speed conveyor whereby the folding pawls of the succeeding pockets, which move at a speed greater than that of the horizontal movement, catch up, and the rear narrow flaps of the preceding box-like items, being horizontally conveyed, are folded. Thereafter, the narrow front flap comes into contact with the folding guide to fold the front flap, and the rear flap is kept in the folded state.

DETAILED DESCRIPTION OF THE PREFERRED EMBODIMENTS

An embodiment of the present invention will now be described hereinbelow with the reference to the accompanying drawings.

Figure 4:
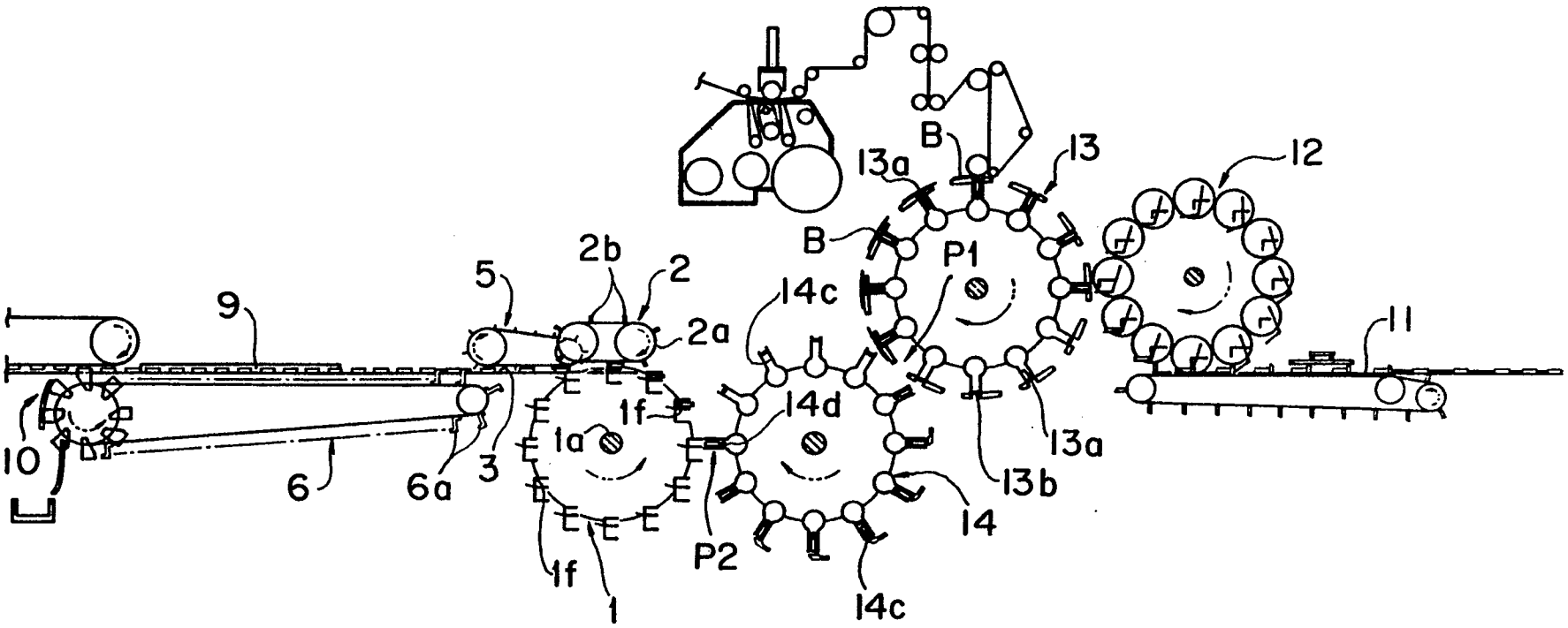
FIG. 4 is a reduced longitudinal sectional front view showing the whole packaging machine.

In this embodiment, as shown in FIG. 4, cigarettes wrapped in a packaging film or paper, as box-like items A (FIG. 1) are continuously supplied at a predetermined intervals by a horizontal conveyor 11. The box-like items A are picked up one by one by a conveying wheel 12 which delivers them to pockets 13*a* of a winding wheel 13. The box-like items A are delivered from the pockets 13*a* of the winding wheel 13 to pockets 14*c* of an applying wheel 14 whereby thermoplastic transparent films such as cellophane, polypropylene and so forth, in the form of packaging sheets B, are wound or wrapped in the shape of a U along the surfaces of the box-like items A. Thereafter, both ends B6 and B7 (FIG. 5) of the packaging sheet B are body-folded along the surface of the box-like item A while being conveyed by the applying wheel 14 and heat-bonded, after which the box-like items A are delivered from the pockets 14*c* to pockets if of a lug folding wheel 1.

Figure 1:
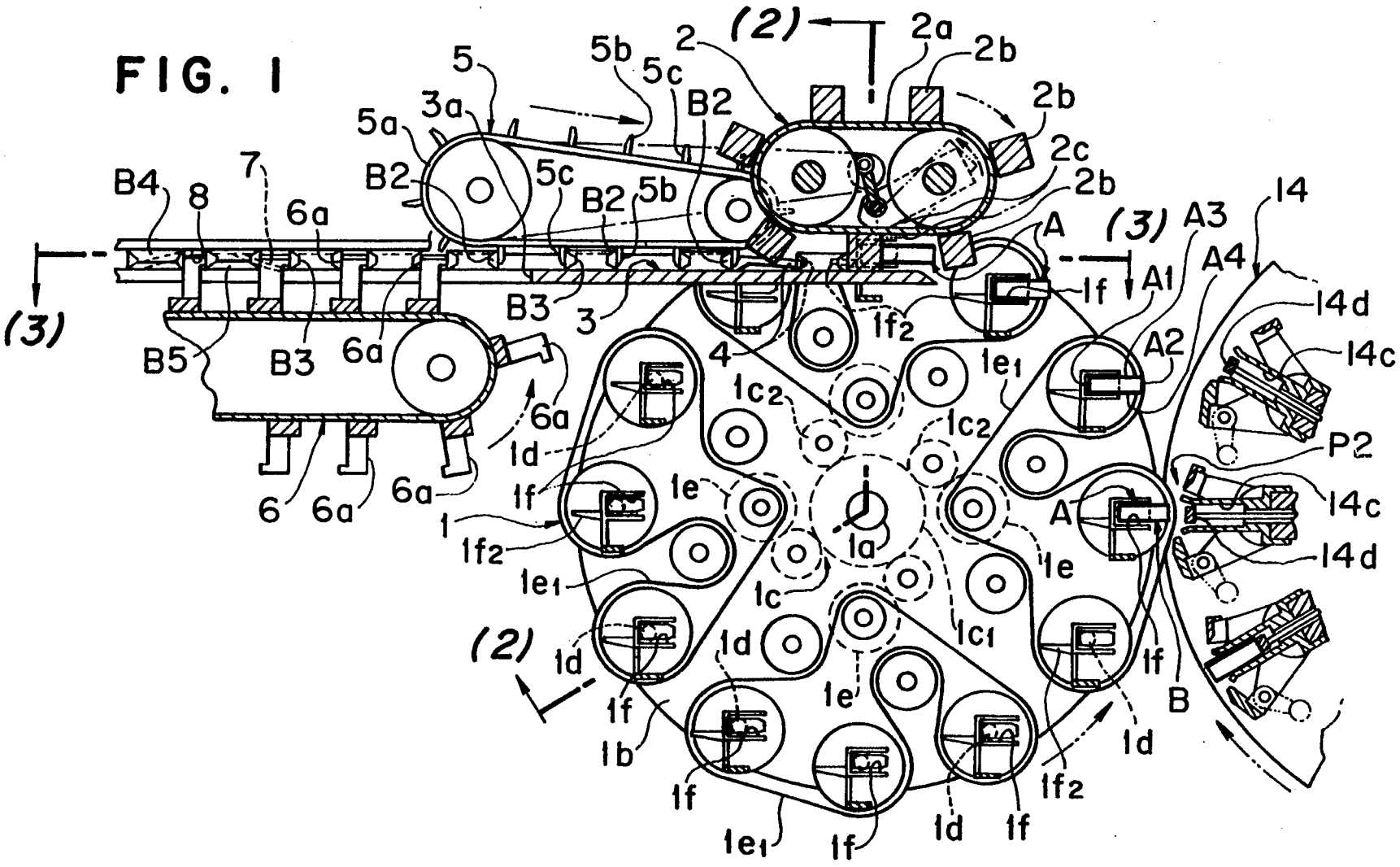
FIG. 1 is a longitudinal sectional front view of a lug folding apparatus for a packaging machine showing an embodiment of the present invention.
Figure 2:
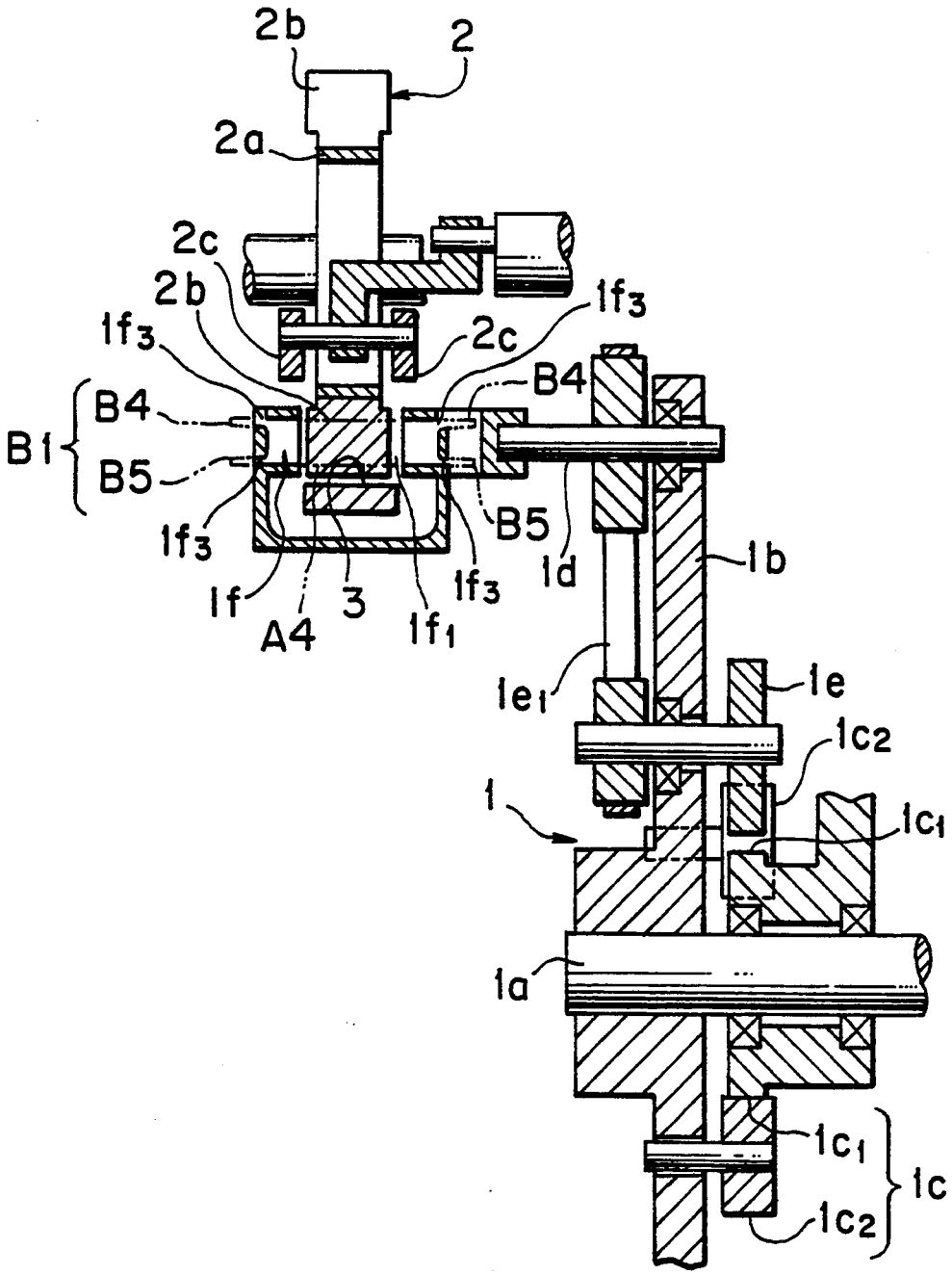
FIG. 2 is a partially enlarged longitudinal sectional side view taken along line 2—2 of FIG. 1.

The lug folding wheel 1 is disposed in parallel and vertically rotatably close to the side of and downstream of the applying wheel 14, which will be described later. A power shaft 1*a* is laterally provided in the center of lug folding wheel 1 and extends in a lateral direction thereof perpendicular to the rotational direction, as shown in FIGS. 1 and 2. Power shaft 1*a* is linked to a driving source for rotating wheel 14 whereby lug folding wheel 1 is continuously rotated counterclockwise, as viewed from the front side, in synchronization with wheel 14 so that the peripheral speed thereof is substantially the same as that of the applying wheel 14.

Power shaft 1*a* is fixedly inserted into the center of a disk 1*b* so that the disk 1*b* is operatively connected therewith for rotation with power shaft 1*a*, and the power shaft 1*a* is rotatably inserted into a sun gear $1c_1$ of a planetary gear mechanism 1*c*. Sun gear $1c_1$ is fixedly retained irrespective of the rotation of the power shaft 1*a*.

In the outer periphery of the disk 1*b*, twelve support shafts 1*d* are rotatably supported at equal intervals in parallel with power shaft 1*a*. A plurality of planetary $1c_2$ meshing with sun gear $1c_1$ of the planetary gear mechanism 1*c*, are rotatably mounted, and a plurality of connection gears 1*e*, meshing with the planetary gears $1c_2$ are also rotatably mounted. Each of the connection gears 1*e* and three support shafts 1*d* are linked by a belt $1e_1$. Thus, planetary gears $1c_2$ and support shafts 1*d* are directly interconnected and pockets if are secured to support shafts 1*d*.

Accordingly, power shaft 1*a* causes lug folding wheel 1 to be rotated counterclockwise, as viewed from the front side, whereby disk 1*b* rotates counterclockwise and pockets 1*f* are rotated in the same direction via support shafts 1*d*. At the same time, planetary gears $1c_2$ of planetary gear mechanism 1*c* rotate about sun gear $1c_1$ and rotate counterclockwise. With this, support shafts 1*d* rotate clockwise so that the relative positions of the twelve pockets if are maintained at a predetermined angle, more specifically in the horizontal state or plane irrespective of the rotational position of the lug folding wheel 1.

Figure 3:
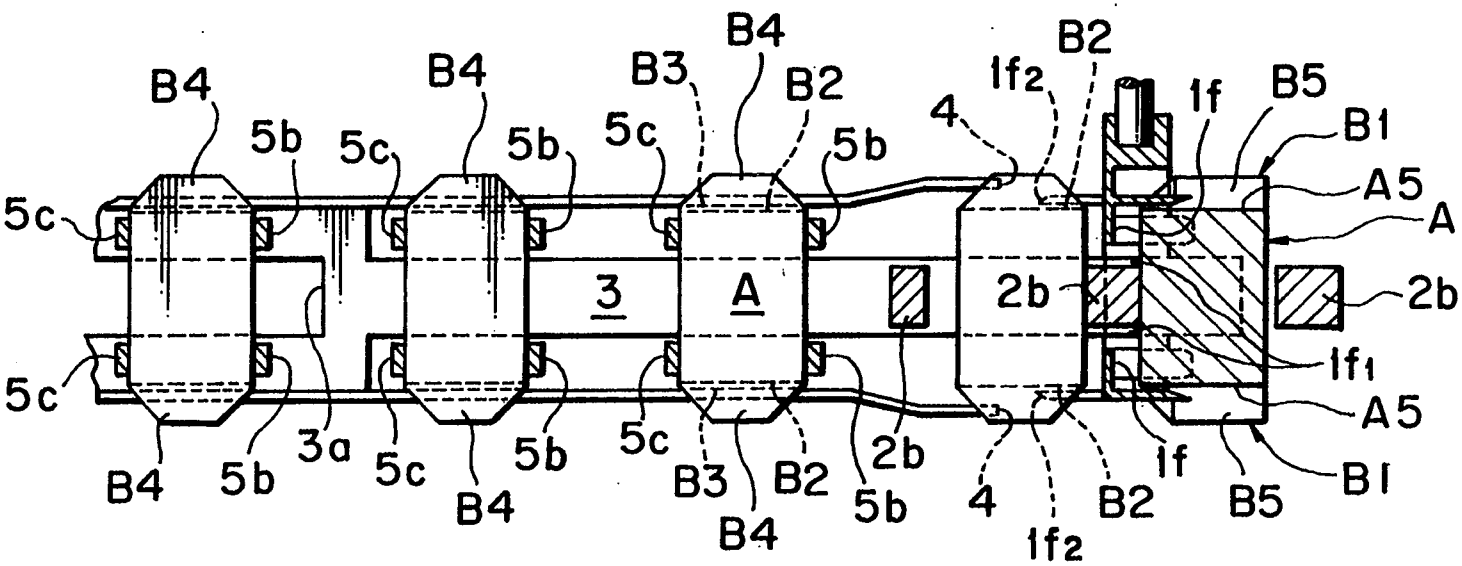
FIG. 3 is a partially enlarged cross-sectional plan view taken along line 3—3 of FIG. 1.

Pockets 1*f* are formed into box-shapes, having substantially the same size as the external dimensions of box-like items A, the upstream sides of pockets 1*f* are open and applying wheel 14 is arranged oppositely of the front surface A1 and the upper and lower surfaces A3 and A4 of box-like items A. Pockets if are laterally divided into two sections so that spaced portions $1f_1$ are provided opposite to left and right central portions of the box-like items A. On the left and right side ends of pockets if on the downstream side, folding pawls $1f_2$ are forwardly projected toward narrow rear flaps B2 and B2 of extended ends B1 and B1, of the packaging sheet B, which protrude from the left and right sides A5 and A5 of the preceding box-like items A, as best seen in FIG. 3. Slits $1f_3$ (FIG. 2) are formed in parallel through which wide upper flaps B4, B4 and lower flaps B5, B5 of the extended ends B1, B1 are extended.

The low speed conveyor 2 is constructed as follows: A belt 2*a* is horizontally extended above lug folding wheel 1. On the outer periphery of the belt 2*a*, projections 2*b*, opposite to the front surface A1 and the rear surface A2 of the box-like item A, are positioned at equal intervals on the same vertical surface as spaced portions $1f_1$ of pockets 1*f*. The moving orbit of the projections 2*b* is partly in contact with the upper end of the moving orbit of the pockets 1*f*, and a driving source thereof is linked to a driving source of the lug folding wheel 1 in a manner that the projections 2*b* are continuously moved a lower speed than the horizontal moving speed of the pockets 1*f*.

Further, in low speed conveyor 2, the spacing between projections 2*b* is slightly greater than the width dimension of the box-like item A in a horizontally conveying direction. This construction determines the timing at which pockets 1*f* enter the moving orbit of the projections 2*b* upon the rotation of the lug folding wheel 1. Draw-off pushers 2*c* are provided to extend or push box-like items A, inserted between projections 2*b*, toward the conveying path 3, which will be described later.

Draw-off pushers 2*c* are disposed for vertical reciprocation oppositely of the left and right sides of the upper surface A3 of the box-like item A, as inserted between projections 2*b*. The driving portion therefor is linked to the driving source of the lug folding wheel 1 and the low speed conveyor 2, or is linked to high speed conveyor 5, which will be described later. As shown, when projections 2*b*, having box-like items A inserted therebetween, arrive at a predetermined position, draw-off pushers 2*c* are moved downwardly to allow the box-like item A to take a horizontal attitude by extending or pushing same downwardly.

A conveying path 3 is horizontally laterally provided on the same vertical surface as spaced portions $1f_1$ of the pockets 1*f* from the upper portion of the lug folding wheel 1 toward a high speed conveyor 5, which will be described later. Conveying path 3 is opposed to and parallel with a straight line portion of the speed conveyor 2 and a straight line portion of the high speed conveyor 5. A spacing shorter than the vertical dimension of box-like item A is formed between the upper surface and the extreme end of the projections 2*b* of the low speed conveyor 2, and a through-hole or opening 3*a*, through which a push plate 6*a* of a conveyor 6, which will be described later, is inserted.

On the left and right sides of conveying path 3, along its respective side edges folding guides 4, 4 are fixedly arranged on the same vertical surface as the left and right sides A5, A5 of the box-like items A within the pockets 1*f*. Guides 4, 4 are located opposite to narrow front flaps B3, B3 of extended ends B1, B1 found on the box-like items A. The extreme ends of folding guides 4, 4 are arranged in the proximity of the moving orbit of folding pawls $1f_2$ of the pockets 1*f*, whereby, when the projections 2*b*, of low speed conveyor 2 having the box-like items A inserted therein, arrive at a predetermined position, folding pawls $1f_2$, $1f_2$ are brought into contact with the rear flaps B2, B2 substantially simultaneously with the abutment of the extreme ends of folding guides 4, 4 with front flaps B3, B3.

High speed conveyor 5 is constructed as follows: A pair of left and right belts 5*a*, 5*a* are horizontally extended downstream of low speed conveyor 2. On the outer periphery of the belts 5*a*, 5*a*, a plurality of pressing and feeding pawls 5*b*, 5*b*, opposed to the rear surfaces A2 of the box-like items A, are projected at equal intervals on the same vertical surfaces of the left and right sides of the box-like items A within the pockets 1*f*. The upstream end of the moving orbit of pressing and feeding pawls 5*b*, 5*b* is partly superimposed on the downstream end of the moving orbit of the low speed conveyor 2. The driving source thereof is linked to the driving source of the lug folding wheel 1, in a manner that pressing and feeding pawls 5*b*, 5*b* are continuously moved at a moving speed equal to or higher than the horizontal moving speed of the pockets 1*f*, of the lug folding wheel 1, in synchronization with the rotational speed of lug folding wheel 1.

In addition, high speed conveyor 5 is set to the timing at which projections 2*b* are moved into the moving orbit of pressing and feed pawls 5*b*, 5*b* by the operation of the low speed conveyor 2 in order to move pressing and feeding pawls 5*b*, 5*b*. Downstream of pressing and feeding pawls 5*b*, 5*b*, stop pawls 5*c* are projected, as needed, in spaced relation and at the same dimension as the width of respective box-like items A in a horizontally conveying direction.

Furthermore, downstream of the high speed conveyor 5, a further conveyor 6, is laterally provided below the through-hole 3*a* of the conveying path 3, with conveyor 6 having push plates 6*a*, provided in a upright manner and at equal intervals opposite to the rear surfaces A2 of the box-like items A. Above conveyor 6, folding up guides 7, 7, for folding up wide lower flaps B5, B5, and folding down guides 8, 8, for folding down wide upper flaps B4, B4, are fixedly arranged on the left and right sides of the conveying path 3. Downstream of folding up guides 7, 7 and folding down guides 8, 8, seal heaters 9, 9 are disposed to seal extended ends B1, B1 of the packaging sheet B folded along the left and right sides A5, A5 of the box-like item A. Downstream thereof, an article removing device 10 is disposed to remove both defective articles generated during the packaging process and specific box-like items A for quality control checks.

Figure 5:
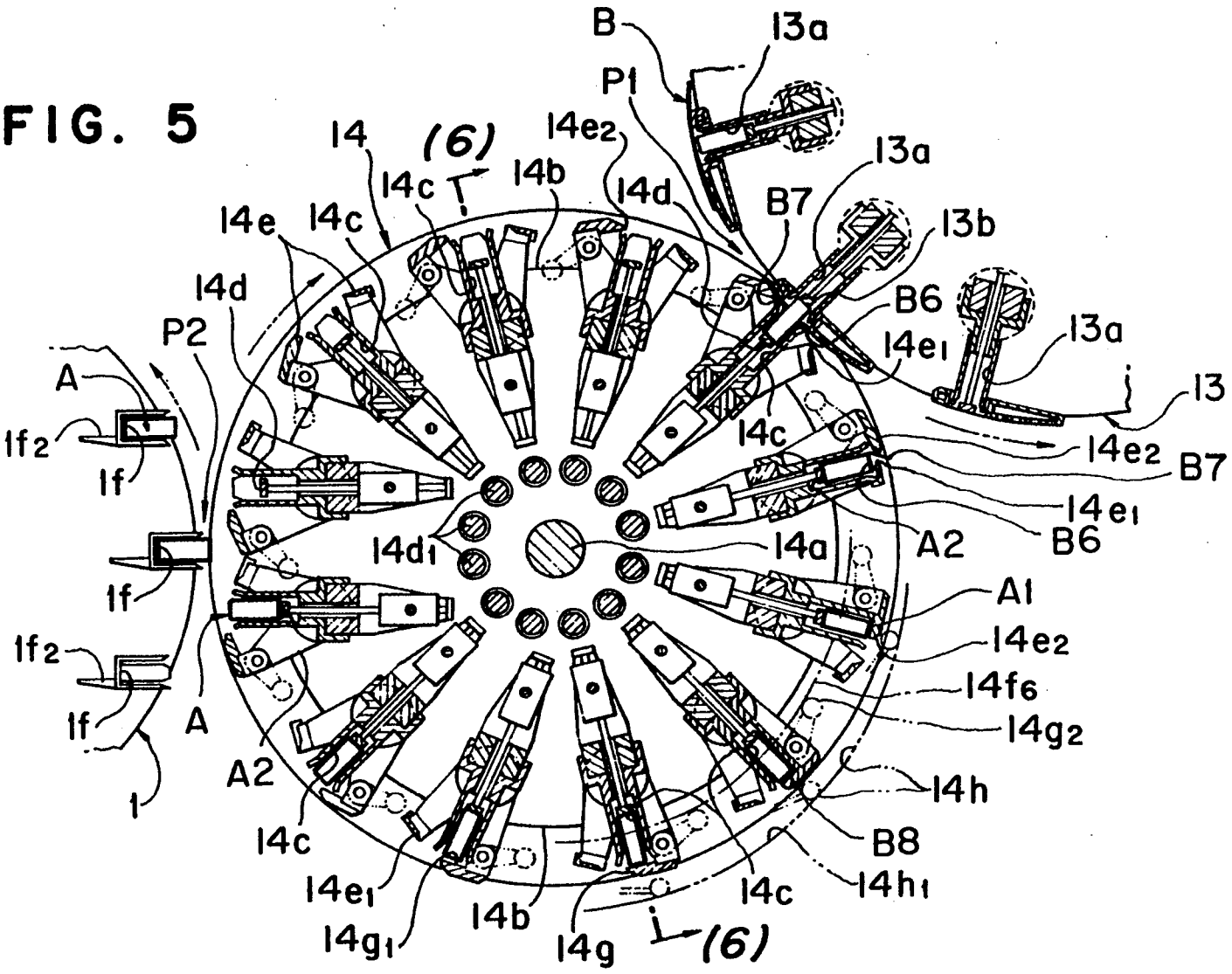
FIG. 5 is a partially enlarged longitudinal sectional front view of an applying wheel.
Figure 6:
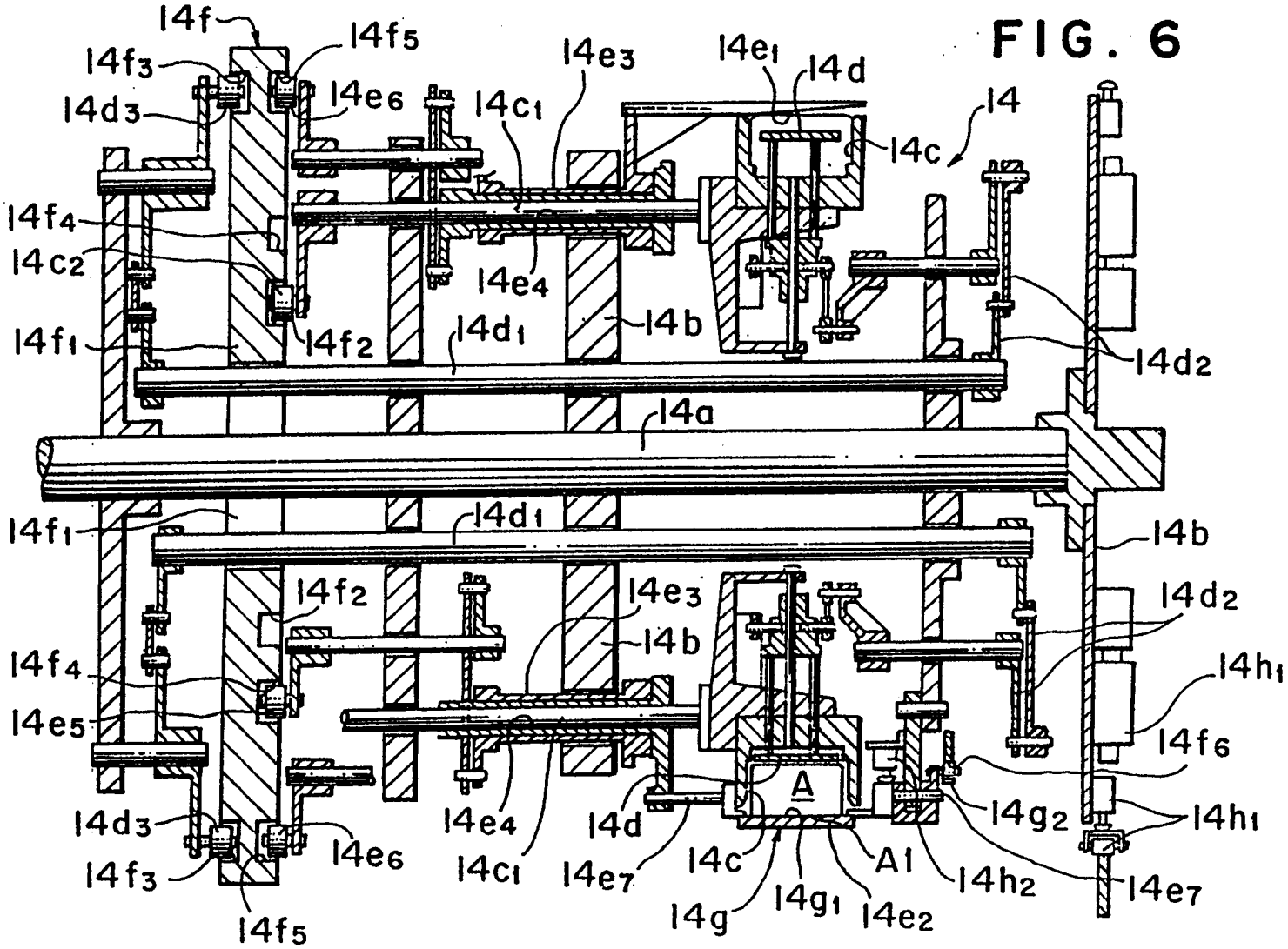
FIG. 6 is an enlarged longitudinal sectional side view taken along line 6—6 of FIG. 5.

On the other end, the aforesaid applying wheel 14 is vertically rotatably disposed in the proximity and 45 degrees below and downstream of winding wheel 13 which in turn is arranged upstream of wheel 14. A power shaft 14*a* acting as the rotating center thereof, is laterally horizontally arranged as shown in FIGS. 5 and 6. Power shaft 14*a* is linked to the driving source of winding wheel 13 whereby winding wheel 15 is continuously rotated clockwise, as viewed from the front, so that the peripheral speed thereof is substantially the same as that of winding wheel 13.

Power shaft 14*a* is fixedly inserted into the center of disk 14*b*, with disk 14*b* thus being operatively connected for rotation with the power shaft 14*a*. Twelve rotational shafts $14c_1$ are rotatably supported in the outer periphery of the disk 14*b* in parallel with power shaft 14*a* and at equal intervals. At the extreme ends of rotational shafts $14c_1$, pockets 14*c* are radially fixed about the diametrically central part of the power shaft 14*a*. Pockets 14*c* are rockably supported by the rotation of rotational shafts $14c_1$. Internally of rotational shafts $14c_1$, twelve rotational shafts $14d_1$, of pushers 14*d*, which will be described later, are rotatably supported in parallel with power shaft 14*a* at peripherally equal intervals. Each of pockets 14*c* is formed into a box-shape having substantially the same size as the external dimension of the box-like item A, with the outer surface of pockets 14*c* being open. Interior of pockets 14*c* pushers 14*d* are provided for moving in and out in the radial direction of applying wheel 14. On the periphery of the pocket opening, folding pawls $14e_1$ and folding pieces $14e_2$, which together constitute a folding mechanism 14*e*, are provided and are accessible to outer surfaces A1 of the box-like items A when fed into pockets 14*c*.

Pushers 14*d* are oppositely disposed to inner surfaces A2 of box-like items A, fed into the pockets 14*c*, and linked to rotational shafts $14d_1$ through links $14d_2$. Rotational shafts $14c_1$ of the pockets 14*c* and the rotational shafts $14d_1$ of the pushers 14*d* are also linked to control cams 14*f*, which will be described later.

Folding pawls $14e_1$ and folding pieces $14e_2$ are oppositely disposed to both free ends B6, B7 of packaging sheets B. Folding pawls $14e_1$ are provided on hollow shafts $14e_3$, which in turn are rotatably provided on the outer periphery of the rotational shafts $14c_1$ to which pockets 14*c* are secured. Folding pieces $14e_2$ are provided on rotational tubes $14e_4$, which in turn are rotatably provided on the outer periphery of rotational shafts $14c_1$. Hollow shafts $14e_3$, of the folding pawls $14e_1$, and rotational tubes $14e_4$, of the folding pieces $14_2$, are also linked to control cam 14*f* which will now be described.

Control cam 14*f* is configured as follows: On a cam plate $14f_1$, fixedly disposed and parallel with and apart from the applying wheel 14 are angularly formed, a groove cam $14f_2$, for controlling positions of pockets 14*c*, wherein rotational shafts $14c_1$ are engaged through driven rollers $14c_2$; a groove cam $14f_3$ for controlling positions of pushers 14*d* wherein rotational shafts $14d_1$ are engaged through driven rollers $14d_3$; a groove cam $14f_4$ for controlling positions of folding pawls $14e_1$ wherein the hollow shafts $14e_3$ are engaged through driven rollers $14e_5$; and a groove cam $14f_5$ for controlling positions of the folding pieces $14e_2$ wherein the rotational tubes $14e_4$ are engaged through driven rollers $14e_6$. A fixed cam $14f_6$ is located in an upright manner opposite to driven rollers $14g_2$ of seal heaters 14g, which will be described later.

On the control cam 14f, as power shaft 14a rotates, pockets 14c, pushers 14d, folding pawls $14e_1$ and folding pieces $14e_2$ all rotate clockwise. AT the same time, driven rollers $14c_2$, $14d_3$, $14e_5$ and $14e_6$ move along the groove cams $14f_2$, $14f_3$, $14f_4$ and $14f_5$, respectively, of the cam plate $14f_1$. When the relative position of the driven rollers $14c_2$ is changed, rotational shafts $14c_1$ are rotated. In a predetermined section before and after a delivery position P1 (FIG. 5) at which each of the pockets 14c is opposed on a straight line by pocket 13a, of the winding wheel 13, in the present embodiment, each pocket 14c is rocked from the arrival of the applying wheel 14 at an angle corresponding to about the one o'clock position to the arrival thereof at an angle corresponding to about the two o'clock position to maintain same on the straight line with pocket 13a of winding wheel 13.

Thereafter, in a predetermined section before and after a delivery position P2 (FIG. 5) at which position each of pockets 14c is opposed on a straight line by pocket 1f, of the lug folding wheel 1, in the present embodiment, each pocket 14c is rocked from the arrival of the applying wheel 14 at an angle corresponding to about the half past eight o'clock position to the arrival thereof at an angle corresponding to about the half past nine o'clock position to maintain same on the straight line with pocket 1f of lug folding wheel 1.

Further, when the relative position of the driven rollers $14d_3$ is changed, rotational shafts $14d_1$ are rotated. In a predetermined section before and after a delivery position P1, at which each of the pockets 14c is opposed on a straight line by pocket 13a, of the winding wheel 13, in the present embodiment, as applying wheel 14 shifts from the arrival thereof at an angle corresponding to about the one o'clock position toward an angle corresponding to about the two o'clock position, pusher 14d is operatively connected with the protruding movement of pusher 13b, of the winding wheel 13, to retract or infeed inner surface A2 of box-like item A being infed while coming into contact therewith. After this, in a predetermined section before and after a delivery position P2 (FIG. 5), at which position each of the pockets 14c is opposed on a straight line by pocket 1f, of the lug folding wheel 1, in the present embodiment, applying wheel 14 shifts from the arrival thereof at an angle corresponding to about the eight o'clock position toward an angle corresponding to about the ten o'clock position, with pusher 14d being then extended.

When the relative position of driven rollers $14e_5$ and $14e_6$ is changed, hollow shaft $14e_3$, of folding pawls $14e_1$, and rotational tubes $14e_4$, of folding pieces $14e_2$, are rotated. As each of pockets 14c moves to a position at a predetermined angle, in the present invention, applying wheel 14 shifts from the arrival at an angle corresponding to about the half past one o'clock position to an angle corresponding to about the half past two o'clock position, with folding pawl $14e_1$ being rotated counterclockwise so as to impinge on one free end B6 of the packaging sheet B. Thereafter, as wheel 14 moves to an angle corresponding to about the three o'clock position, folding pawl $14e_1$ is moved clockwise.

At the same time, as each one of pockets 14c moves to a position at a predetermined angle, in the present embodiment, as the applying wheel 14 shifts from the arrival thereof at an angle corresponding to about the one o'clock position to an angle corresponding to about the three o'clock position, folding piece $14e_2$ is moved clockwise at a speed lower than the protruding speed of the folding pawl $14e_1$ to impinge on the other free end B7 of the packaging sheet B so that it is superimposed on the outside of the one free end B6. Thereafter, as wheel 14 shifts from the arrival at an angle corresponding to about the six o'clock position to an angle corresponding to about the half past eight position, folding piece $14e_2$ is moved counterclockwise.

Folding pieces $14e_2$ are movably supported inwardly and outwardly in the radial direction of the applying wheel 14 through support shafts $14c_1$ which in turn are supported in the inner periphery of the rotational tubes $14e_4$. Seal heaters 14g are integrally provided to form heater surfaces $14g_1$ on portions of folding pieces $14e_2$, opposed to the outer surfaces A1 of the box-like items A being fed into pockets 14c. Driven rollers $14g_2$ are rotatably supported opposite to fixed cams $14f_6$ of control cam 14f. A mechanism 14h is provided for moving heater surfaces $14g_1$ away from the outer surfaces A1 of the box-like items A.

Fixed cams $14f_6$ of the control cam 14f are circularly formed opposite to the power shaft 14a side of the driven rollers $14g_2$ of seal heaters 14g. A resilient member (not shown) such as a spring, is provided to always bring driven rollers $14g_2$ into contact with the fixed cam $14f_6$. As power shaft 14a rotates, driven rollers $14g_2$ are moved along the fixed cam $14f_6$. Thereby, the heater surfaces $14g_1$ are controlled in position to move each of the pockets 14c to a position of a predetermined angle. In the present embodiment, heater surfaces $14g_1$ are pressed against the outer surfaces A1 of the box-like items A through the overlapping portions B8 of packaging sheet B until applying wheel 14 shifts from the arrival thereof at an angle corresponding to about the half past three o'clock position to an angle corresponding to about the six o'clock position.

Separating mechanism 14h is constructed as follows: The rotational speed of the power shaft 14a is sensed by a detection mechanism (not shown) such as a rotary encoder, for example. A timer portion $14h_1$, comprised of a timer and a movable cam is actuated in response to the detected signal. Simultaneously, with the start of the timer, heater surfaces $14g_1$ are separated from the overlapping portions B8 by a separating portion $14h_2$ comprised of an air cylinder, for example. Thereby, after a lapse of a fixed period of time, when the heater surfaces $14g_1$ are pressed against the overlapping portions B8 of the packaging sheet B, irrespective of the rotational speed of the applying wheel 14, the heater surfaces $14g_1$ are separated form the overlapping portions B8.

The operation of the above described lug folding apparatus for a packaging machine will be described hereinbelow.

First, the pockets 14c, each having the box-like item A and the packaging sheet B infed thereinto, as shown in FIG. 5, are circularly conveyed by the continuous rotation of applying wheel 15. Folding pawl $14e_1$, of the folding mechanism 14e, is moved by control cam 14f to fold one end B6, of the packaging sheet B, along outer surface A1 of the box-like item A. Folding piece $14e_2$ is moved somewhat later to fold the other end B7, of packaging sheet B, along outer surface A1 of box-like item A, with end B7 being superimposed on the outside of one end B6. Heater surface $14g_1$ of the seal heater 14g is pressed against overlapping portion B8 to heat-bond overlapping portion B8.

In the case where the rotational speed of applying wheel 14, at that time, is above a set speed, separating mechanism 14h is not actuated, and when heater surface $14g_1$ reaches the position of a predetermined angle, via control cam 14f, heater surface $14g_1$ is separated from overlapping portion B8.

On the other hand, in the case where rotational speed of applying wheel 14 is below a set speed, separating mechanism 14h is actuated, and after a lapse of a fixed time when the heater surface $14g_1$ is pressed against overlapping portion B8, heater surface $14g_1$ is separated at the time before heater surface $14g_1$ arrives at the separating position via the action of the control cam 14f.

Thereafter, when pocket 14c arrives at a point near delivery position P2, to assume a straight line with the pocket 1f of the lug folding wheel 1, pusher 14d (FIG. 1) is extended by control cam 14f. Box-like item A having been contacted is extended and delivered from pocket 14c to pocket 1f of lug folding wheel 1.

At that time, the narrow front flaps B3, B3 of the extended ends B1, B1 of the packaging sheet B, protruding from the left and right sides A5, A5 of the box-like item A, impinge on the open edge of the pocket 1f and are folded along the left and right sides A5, A5 of the box-like item A. The upper flaps B4, B4 and lower flaps B5, B5 of the extend ends B1, B1 pass through the slits $1f_3$ of pocket 1f and protrude outwardly to left and right as shown in FIGS. 2 and 3.

Thereafter, pockets 1f, each having the box-like item A fed thereinto, are circularly conveyed upwardly by the continuous rotation of lug folding wheel 1. When the pocket 1f moves close to low speed conveyor 2 and into the moving orbit of projections 2b, the left and right central portions of the box-like item A, within the pocket 1f, gradually move in between the projections 2b form the bottom. Box-like items A are moved relatively upstream due to the difference between the horizontal moving speed of the pockets 1f and the horizontal moving speed of the projections 2b and are thus removed from pockets 1f.

In the case where packaging sheet B is a film of cellophane, polypropylene or the like, box-like item A is removed from the pocket 1f of the lug folding wheel 1, and at the same time, the narrow front flaps B3, B3 of the extended ends B1, B1 return to their unfolded state.

If the thusly removed box-like item A is put in between projections 2b in the horizontal state, it falls on the conveying path 3 due to its own gravity. However, when box-like item A is put in between projections 2b in an inclined state, it is caught and does not fall. In this case, box-like item A is brought to a horizontal state by the downward movement of draw-off pusher 2c and falls on conveying path 3.

Thereafter, box-like items A are horizontally conveyed at a speed lower than the horizontal moving speed of the pockets 1f along the conveying path 3 by the extreme ends of the projections 2b via the continuous operation of low speed conveyor 2. The spacing between aforesaid box-like item A and a box-like item A, within the pocket 1f, is gradually narrowed, and finally the succeeding pocket 1f catches up with the preceding box-like item A. Folding pawls $1f_2$, $1f_2$ impinge upon the narrow rear flaps B2, B2 of the extended ends B1, B21 of the preceding box-like items A, and the rear flaps B2, B2 are folded downstream along the left and right sides A5, A5 of box-like items A.

Substantially simultaneously therewith, narrow front flaps B3, B3 of the extended ends B1, B1 of box-like items A impinge upon the folding guides 4, 4, and the front flaps B3, B3 are again folded downstream along the left and right sides A5, A5 of box-like items A to maintain the folded state. Immediately thereafter, folding guides 4, 4 come into contact with rear flaps B2, B2 after being folded by the folding pawls $1f_2$, $1f_2$ to maintain the folded state.

Thereafter, the conveyance of box-like items A is taken over from the projections 2b of the low speed conveyor 2 by the pressing and feed pawls 5b, 5b of high speed conveyor 5. The conveying speed is increased, and pockets 1f, circularly downwardly conveyed by the rotation of lug folding wheel 1, are gradually moved away from the moving orbit of projections 2b without coming into contact with rear surfaces A2 of box-like items A, and at the same time, the spacing between preceding box-like items A and the succeeding box-like items A is increased.

After the conveyance of the box-like items A has been taken over from pressing and feed pawls 5b, 5b, of high speed conveyor 5, by pressing plates 6a of conveyor 6, wide lower flaps B5, B5 of the extended ends B1, B1, of box-like items A, are folded up by the folding up guides 7, 7. After this, wide upper flaps B4, B4 are folded down by folding down guides 8, 8.

While in the illustrated embodiment, cigarettes wrapped by a packaging film or paper have been used as the box-like articles A, it is to be understood that the articles are not limited thereto but that box-like items A may be those other than packaged cigarettes. Furthermore, while high speed conveyor 5 has been disposed along conveying path 3 downstream of low speed conveyor 2, other constructions may be employed if they operate similarly without being limited thereto.

The present invention has the following effects:

As the lug folding wheel continuously rotates, the pockets, having the box-like items fed therein, are circularly conveyed while maintaining their horizontal state, and the projections of the low speed conveyor move into the pockets to impinge on the box-like items. Thereby, the box-like items are relatively pressed and fed toward the opening form the pockets, due to the difference in the horizontal moving speed between the pockets and the low speed conveyor, and transferred to the horizontal conveying path. The packaged box-like items are transferred from the continuous circular conveyance to the linear conveyance without being stopped.

Accordingly, as compared to the conventional system in which the box-like items are transferred from the tray conveyor for intermittently rotating the box-like items continuously conveyed by the pockets of the winding wheel and the pockets of the chain conveyor to the linear conveyor, the lug folding wheel can be rotated a high speed, and the previous low speed conveyor can be operated a high speed, thus increasing the processing speed and making it possible to provide a large quantity of packages.

The box-like items transferred to the conveying path are horizontally conveyed by the projections of the low speed conveyor, whereby the folding pawls of the succeeding pockets, which are faster than the horizontal movement, catch up. The narrow rear flaps, of the preceding box-like items being horizontally conveyed, are folded, after which the narrow front flaps come into contact with the folding guides, to fold the front flaps, and the folding state of the rear flaps is maintained. Thus, the narrow rear flaps, after being extended from the pockets, may be re-folded.

Accordingly, as compared to the conventional system, in which the narrow flaps of the extended ends are merely folded when the box-like items are pushed into the pockets, and when being extended from the pockets, the once folded flaps sometime return to their original unfolded state, even if the packaging sheet is a film such as cellophane, polypropylene or the like, the narrow flaps are not returned to their original unfolded state after having been folded. Defective folding is eliminated, and occurrence of defective goods can be prevented.

I claim:

1. A lug folding apparatus for a packaging machine in which box-like items, fed into pockets, undergo a continuous circular conveyance, during which conveyance a packaging sheet is wound along the surface of each of said box-like items, the wound box-like items are transferred from the continuous circular conveyance to a linear conveyance, and extended ends of the packaging sheet, protruding angularly from both sides of each box-like item, are folded along both sides thereof, said lug folding apparatus comprising:

a continuously rotating lug folding wheel, said lug folding wheel having an outer periphery, said outer periphery being provided with a plurality of pockets, said pockets having openings and said wound box-like items being fed into said pockets at equal intervals, said rotating lug wheel rotating said box-like items in said pockets in a moving orbit at a moving speed;

a low speed conveyor which is partly in contact with the moving orbit of said pockets at a predetermined portion of said moving orbit, the moving speed at said predetermined portion having a horizontal component, means for moving said low speed conveyor in parallel and at a speed lower than said horizontal component of the moving speed of said pockets, said low speed conveyor having first projections for contacting a box-like item to transfer the box-like item from a pocket;

structure defining a horizontal conveying path opposite to said low speed conveyor at said predetermined portion, wherein said pockets are circularly moved, while maintaining a horizontal state, by the rotation of said lug folding wheel, said pockets being provided with spaced portions to which said first projections of the low speed conveyor and the conveying path have access, whereby, a first projection contacts a box-like item to transfer the box-like item from a pocket to said horizontal conveying path; and a high speed conveyor disposed along said conveying path downstream of said low speed conveyor;

said low speed conveyor including second projections, said second projections being linked to and driven by said high speed conveyor to contact said box-like items, within said pockets to press and feed said box-like items towards the openings of said pockets, said second projections being projected toward said conveying path.

2. The lug folding apparatus for a packaging machine of claim 1, wherein said wound box-like items include extended ends, said extended ends in turn including narrow rear and front flaps, said apparatus further including folding pawls projected on the pockets of said lug folding wheel, said folding pawls being opposite to said narrow rear flaps of said extended ends of preceding box-like items; and folding guides fixedly arranged on the left and right sides of the conveying path and located in the same planes as the left and right sides of the box-like items to be horizontally conveyed, said folding guides being located opposite to said narrow front flaps of said extended ends of said box-like items.

3. The lug folding apparatus for a packaging machine of claim 2, wherein said extended ends of said box-like items also include wide lower and upper flaps, said apparatus further including, downstream of said first folding guides, a folding up guide for folding up said wide lower flap of said extended end; and a folding down guide for folding down the wide upper flap, said folding up and folding down guides being arranged on the left and right sides of said conveying path.

4. The lug folding apparatus for a packaging machine of claim 2, wherein said extended ends of said box-like items also include wide upper and lower flaps, said apparatus further including, downstream of said first folding guides, a folding up guide for folding said wide lower flaps of said extended end; and a folding down guide for folding down the wide upper flap, said folding up and folding down guides being arranged on the left and right sides of said conveying path.

5. A lug folding apparatus for a packaging machine in which box-like items, fed into pockets, undergo a continuous circular conveyance, during which conveyance a packaging sheet is wound along the surface of each of said box-like items, the wound box-like items are transferred from the continuous circular conveyance to a linear conveyance, and extended ends of the packaging sheet, protruding angularly from both sides of each box-like item, are folded along both sides thereof, said lug folding apparatus comprising:

a continuously rotating lug folding wheel, said lug folding wheel having an outer periphery, said outer periphery being provided with a plurality of pockets, said pockets having openings and said wound box-like items being fed into said pockets at equal intervals, said rotating lug wheel rotating said box-like items in said pockets at a moving speed;

a low speed conveyor which is partly in contact with said rotating pockets at a predetermined portion of said moving orbit, the moving speed at said predetermined portion having a horizontal component, means for moving said low speed conveyor at a speed lower than said horizontal component of the moving speed of said pockets, said low speed conveyor having first projections for contacting a box-like item to transfer the box-like item from a pocket;

structure defining a horizontal conveying path in the proximity of said predetermined portion of said low speed conveyor, wherein said pockets are circularly moved, while maintaining a horizontal state, by the rotation of said lug folding wheel, said pockets being provided with spaced portions to which said first projections of the low speed conveyor and the conveying path have access, whereby, a first projection contacts a box-like item to transfer the box-like item from a pocket to said horizontal conveying path; and a high speed conveyor disposed along said conveying path downstream of said low speed conveyor;

said low speed conveyor including second projections, projecting toward said conveying path, said second projections being linked to and driven by said high speed conveyor to contact said box-like items, within said pockets to press and feed said box-like items towards the openings of said pockets.

6. The lug folding apparatus for a packaging machine of claim 5, wherein said wound box-like items include extended ends, having narrow rear and front flaps, said apparatus further including folding pawls projected on the pockets of said lug folding wheel, opposite to said narrow rear flaps of said extended ends of preceding box-like items; and folding guides fixedly arranged on the left and right sides of the conveying path, and located in the same planes as the left and right sides of the box-like items to be horizontally conveyed, said folding guides being located opposite to said narrow front flaps of said extended ends of said box-like items.

7. The lug folding apparatus for a packaging machine of claim 6, wherein said extended ends of said box-like items also include wide lower and upper flaps, said apparatus further including a folding up guide, downstream of said first folding guides, for folding up said wide lower flap of said extended end; and a folding down guide for folding down the wide upper flap, said folding up and folding down guides being arranged on opposite sides of said conveying path.

8. The lug folding apparatus for a packaging machine of claim 6, wherein said extended ends of said box-like items also include wide upper and lower flaps, said apparatus further including a folding up guide for folding said wide lower flaps of said extended end downstream of said folding guide; and a folding down guide for folding down said wide upper flap.

* * * * *